US007304276B2

(12) United States Patent
Lin et al.

(10) Patent No.: US 7,304,276 B2
(45) Date of Patent: Dec. 4, 2007

(54) THICK FILM HEATER INTEGRATED WITH LOW TEMPERATURE COMPONENTS AND METHOD OF MAKING THE SAME

(75) Inventors: Hongy Lin, Chesterfield, MO (US); Thomas M. Laskowski, Pacific, MO (US); Louis P. Steinhauser, St. Louis, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 567 days.

(21) Appl. No.: 09/681,891

(22) Filed: Jun. 21, 2001

(65) Prior Publication Data

US 2002/0195444 A1 Dec. 26, 2002

(51) Int. Cl.
*H05B 3/22* (2006.01)

(52) U.S. Cl. ..... 219/543; 338/308; 29/620

(58) Field of Classification Search ..... 219/543, 219/438, 535, 538, 542, 544, 552, 553; 29/620; 338/308

See application file for complete search history.

(56) References Cited

U.S. PATENT DOCUMENTS 3,934,119 A * 1/1976 Trenkler ..... 219/543
4,404,237 A * 9/1983 Eichelberger et al. ..... 338/308
4,446,355 A * 5/1984 Sato et al. ..... 219/543
4,857,384 A * 8/1989 Mio et al. ..... 428/164
5,181,006 A * 1/1993 Shafe et al. ..... 219/543
5,308,311 A * 5/1994 Eggers et al. ..... 600/28
5,475,199 A * 12/1995 Buchanan ..... 219/243
5,859,581 A * 1/1999 Morris ..... 338/50
5,889,261 A * 3/1999 Boardman ..... 219/543
5,945,020 A * 8/1999 Kuroda et al. ..... 219/543
6,121,585 A * 9/2000 Dam ..... 219/438
6,137,089 A * 10/2000 Pragt et al. ..... 219/438
6,222,166 B1 * 4/2001 Lin et al. ..... 219/538
6,233,817 B1 * 5/2001 Ellis et al. ..... 29/832

FOREIGN PATENT DOCUMENTS

JP 02033881 2/1990
JP 04147595 5/1992
JP 08016016 1/1996

* cited by examiner

*Primary Examiner*—J. Pelham
(74) *Attorney, Agent, or Firm*—Brinks Hofer Gilson & Lione

(57) ABSTRACT

A thick film heater is shown wherein the thick film resistive circuit, as the heating element, is applied directly to a target object to be heated for very low temperature applications. The thick film used is polymer-based (preferably epoxy). The thick film resistive circuit is applied using conventional means. However, it is cured at higher temperatures and longer cycles than conventional thick film circuits, and preferably in multiple stages.

32 Claims, 2 Drawing Sheets

THICK FILM HEATER INTEGRATED WITH LOW TEMPERATURE COMPONENTS AND METHOD OF MAKING THE SAME

BACKGROUND OF INVENTION

1. Field of the Invention

The present invention relates to thick film heaters comprising a heating element of electrically resistive thick film circuitry, and more specifically to a heater applied directly to a target object.

2. Description of Prior Art

It is often necessary to heat certain objects ("the target object") for a variety of applications, and it has long been known to accomplish this task with electrical heaters using heating element of an electrically resistive circuit to generate heat. In more recent years it has been known to use heaters with a heating element made of a thick film circuit. It has also been known to use flexible heaters made of two layers of silicon rubber with a wire circuit heating element disposed between the layers. The flexible heater is then placed around the target object. In other applications cartridge heaters comprising a cylindrical metal sheath with a wound heating element disposed therein, are inserted into bores drilled in the target object.

All of these prior heating techniques have serious drawbacks and limitations however. This is particularly true in applications where the target object is used in very low temperatures, for instance 77K, which is the temperature of liquid nitrogen.

For instance, in a cryogenic pump a cartridge heater is conventionally used to heat absorbent for trapping gas molecules and to regulate its temperature to assure proper operation of the pump. There are several limitations to this heating method. Because of the bulk of the heater, there is some distance between the heater and the absorbent to be heated. This longer heat transfer path means longer heat up times, which is compounded by the large thermal mass of a cartridge heater, the additional radiation heat loss, and the limitation on power density (heat flux) when the heater is so distanced from the target. Furthermore, a cartridge heater requires a high precision intermediate thermal conducting layer to improve the contact between the heater and the component. This additional layer (often made of a precious metal) adds significant cost and labor to the pump.

As another example, a DNA analyzer contains a cup holder, which holds plastic cups containing liquids for enzyme reactions to proceed. This cup holder must be heated from extremely low temperatures, and is typically heated using a silicone rubber heated (etched foil type) bonded to the cup holder with an adhesive. The bonding process is very labor intensive and often results in the production of gas bubbles in the adhesive layer. These gas bubbles are poor heat conductors and therefore create zones of localized overheating and uneven temperature distribution overall. These zones also result in delamination of the heater (because of the different zones of thermal expansion) and in many situations, heater failure. The silicone rubber heater suffers from power density limitations that usually limit the heater to 20 $W/m^2$ (3.1 $W/cm^2$).

Many of the above limitations could be overcome, in theory, with the use of thick film heater technology. The thick film resistive circuit could be printed directly on the target object. Unfortunately, thick film heating circuits made of silicone based inks crack after several cycles at such extremely low temperatures, rendering them useless. It is also known to use other polymer-based thick film inks (e.g. epoxy based), but when used at low temperatures, these circuits display gradual changes in resistance with heat cycling. The change in resistance naturally means a change in power density of the heater (assuming constant voltage) which is unacceptable in these applications.

It is thus an object of the present invention to provide a thick film heater integrated with a target object to be heater.

It is a further object of the present invention to provide a thick film heater that can withstand operation in extremely cold ambient temperatures.

It is yet another object of the present invention to provide a novel method or preparing such a thick film heating circuit.

Other objects of the invention will become apparent from the description of the invention, below.

SUMMARY OF INVENTION

In keeping with the above-identified objects, the present invention is a thick film heater integrated with the target object to be heated. The integration is effected by the direct application of the thick film resistive circuit to a surface of the target object.

According to one aspect of the present invention an epoxy-based ink is used to form the thick film resistive circuit, as it is less prone to chipping during the cooling cycle than glass-based inks. Not only is the epoxy-based ink less expensive than glass-based inks, but the technology has not yet been developed to allow glass-based ink dielectrics to be directly applied to aluminum or copper substrates. The ink is typically an epoxy binding with a electrically conductive particles dispersed throughout the binding.

According to another aspect of the present invention, the thick film resistive circuit undergoes multiple curing cycles. While, it is typical to follow the manufacturer's directions for curing the thick film inks, such directions call for a single curing cycle, which as discussed above, results in a circuit prone to resistance fluctuations.

The circuit of the present invention is first cured according to the manufacturer's directions. It is then cured at least one other time at typically higher temperatures for longer cycles.

According to yet another aspect of the present invention, a dielectric layer is disposed over the thick film resistive circuit to protect the circuit from being shorted by foreign objects. The dielectric layer also provides mechanical protection to the circuit. If part of the circuit is chipped away or scratched the resistance of the circuit at that location will increase, which is unacceptable for the types of applications in which the present invention is utilized.

It may also be preferable (and perhaps even necessary) depending on the surface material of the target object to include a dielectric layer below the thick film resistive circuit as well. For instance, if the target object is made of a good electrical conductor, such as a steel, a lower dielectric layer will obviously be needed to prevent shorting.

The means for depositing the thick film resistive circuit on the target object do not differ from the conventional means for creating thick film heaters, and as such are well known to those skilled in the art of designing thick film heaters. For example, thick film heaters are discussed in U.S. Pat. Nos. 6,037,574; 5,973,296; and 6,222,166, all of which having a common assignee herewith and all of which are incorporated herein by reference.

The key differences from conventional prior art heaters, which allows the present invention to fulfill the objectives stated herein, are the careful selection of a polymer-based conductive ink and the development of a multi-stage cure cycle to ensure a stable resistance during actual use.

The resulting heater is a thick film resistive circuit applied directly to a target object. It works in very low temperatures with great reliability and with power densities (heat fluxes) of up to 200 watts per square inch (31 W/cm$^2$).

BRIEF DESCRIPTION OF DRAWINGS

The above-mentioned and other features, advantages, and objects of this invention, and the manner in which they are obtained, will become more apparent and will be best understood by reference to the detailed description in conjunction with the accompanying drawings which follow, wherein.

DETAILED DESCRIPTION

Figure 1:
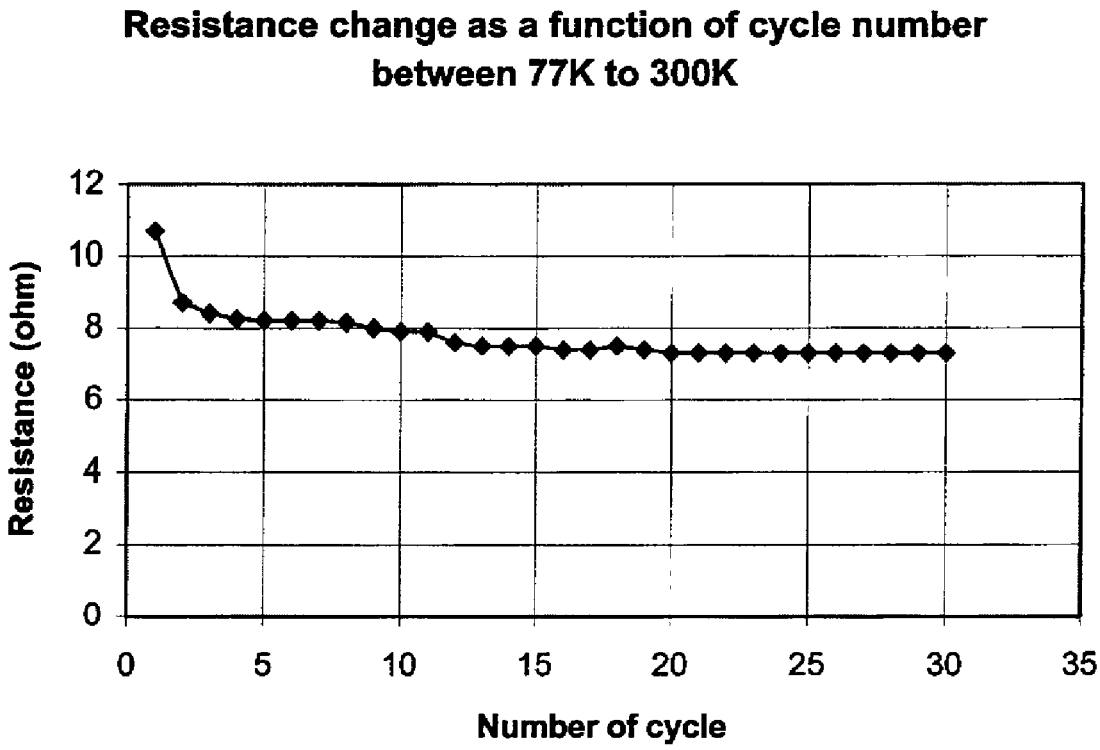
FIG. 1 is a graph demonstrating the stability of resistance in the heating element of one embodiment of the present invention.

The present invention is made primarily by applying a heating element of a thick film resistive circuit directly to a target object or optionally over a dielectric layer applied directly to the target object. For the sake of simplicity, the phrase "directly to a target object" means either in direct contact with the target object or in direct contact with a thick film (or thinner) dielectric layer, which, in turn, is in direct contact with the target object.

The application of the heating element to the target object, as well as the application of any dielectric layers below or above the heating element is performed using any of a wide variety of conventional thick film technologies, such as screen printing, all of which are well known in the art. Two aspects of the present invention in tandem distinguish it from the prior art and allow it to achieve the stated objectives.

The first such aspect is the use of specific polymer-based inks for the thick film circuit, such as an epoxy-based ink. Although other conductive polymer-based inks may perform adequately for this invention, certain polymer-based inks have shown particularly advantageous properties for direct application to a low-temperature target object. Ceramic-based inks will also work with this invention in some applications, but are not preferred due to their higher costs and the inability to use them on non-ferrous metal substrates. Such preferred polymer-based inks include epoxy-based inks from Hereaus Company of West Conshohock, Pa. and Electro Science Laboratories, Inc. of King of Prussia, Pa.

At the time of the present application, the best known ink for the present invention is the T2100 ink (epoxy base with silver conductive particles) on a dielectric layer of PD5200 ink (epoxy base).

In low temperature applications, the bindings of silicone-based inks have become brittle during the cooling cycle and chip at the edges. Such chipping produces resistance changes in the circuit, and could even lead to complete heater failure prematurely.

The second differentiating aspect is the use of additional curing cycles or a single curing cycle at a higher temperature and/or longer duration than conventionally used. The typical directions from the manufacturer for curing the polymer-based inks in a thick resistive circuit involve baking the ink at a temperature of 150° C. for thirty minutes. It has been discovered that such curing cycles do not produce circuits with stable resistance. While a circuit cured according to the normal process, as recommended by the ink manufacturer, might have an initial resistance of 40 Ω for example, after several thousand heating cycles the resistance will be permanently reduced. After as many as 10,000 such cycles, the resistance may be less than 20 Ω—half of the original resistance. Such permanent changes may not take place in the typical thick film application involving a low power density circuit where the temperature change during a single cycle is not dramatic. This is a major reason why thick film circuits are not common place in high power density applications.

By way of example, a target object of nickel-plated copper was prepared with a dielectric paste. The dielectric paste consisted of $TiO_2$ particle filler and cobalt oxide pigment in a polymer-based (epoxy) binding agent. Thinner and thioxtropic forming agent were added to the dielectric to make it suitable for deposition using commonly known silk screening techniques. The dielectric layer was set in an electric oven at temperatures between 50° C. and 150° C. for a period of sixty minutes.

Thereafter a thick film resistive circuit was silk screen printed over the dielectric layer. The resistive ink was a mixture of silver conducting particles in a polymer-based (epoxy) binding agent. Again, thinner and thioxtropic forming agent were added to thin ink to allow for screen printing. The resistive circuit was cured according to manufacturer's specifications—150° C. for thirty minutes. An outer dielectric layer identical to the initial dielectric layer was added over the resistive circuit. The entire heater (target object, dielectric layers, and resistive circuit) was cured for another cycle of 150° C. for sixty minutes.

The resulting heater was capable of functioning at very low temperatures without chipping or cracking. After thirty-five immersions in liquid nitrogen (temperature: 77K) from room temperature the heating element showed no cracking or delamination. The resistance of this heater was also stable after fifty such cycles as illustrated in FIG. 1. While the low temperature stability of the resistance was excellent, cycling the heating element between 40° C. and 125° C. resulted in a constant decrease in resistance. After 7,000 such heating cycles, the resistance of the circuit had decreased approximately 50%.

Figure 2:
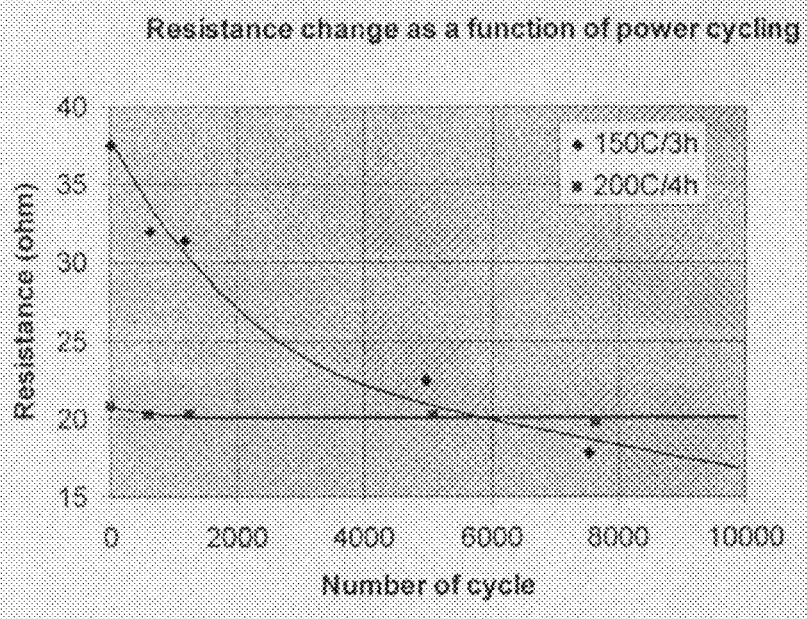
FIG. 2 is a graph comparing resistance change in the heating element of a another embodiment of the present invention with that of a heating element in a more conventional thick film heater.

It has been discovered that a post curing cycle of 200° C. for a longer period of time results in more resistance stability at the higher temperature cycling (40° C. 1250° C.). FIG. 2 shows the comparative change in resistance over approximately 8,000 such cycles for two heaters prepared as above, but post-cured for three hours at 150° C. and four hours at 200° C. The heaters were designed for 100 watts per square inch, but this technology can be used at power densities up to 200 watts per square inch.

Figure 3:
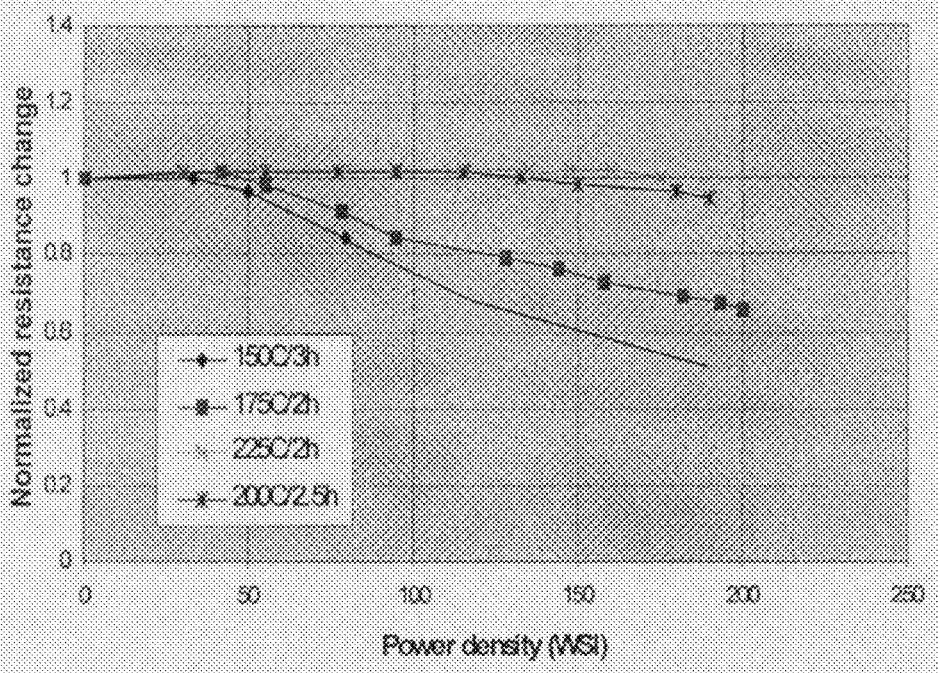
FIG. 3 is a graph illustrating the increasing benefits of the present invention as power density (heat flux) increases.

The improved stability of the higher temperature post-cure treatments is more pronounced at high power densities. FIG. 3 shows the normalized resistance change for four heaters prepared as above but with differing post-cure treatments. As can be seen, at higher power densities the contrast in resistance stability for the four heaters is surprisingly stark. The reason for this dramatic difference is not known, however empirical evidence clearly shows the difference is real. It can also be seen in FIG. 3 that higher temperature in the post-cure treatment are more important than longer treatment times. For instance the resistance stability of a post-cure treatment at 150° C. for three hours was dramatically worse than post-cure treatments at 225° C. for two hours or 200° C. for 2.5 hours.

As mentioned previously, any number of conventional methods may be used to deposit the circuit (or dielectric layers) on the target object. For example, syringe deposition may be used on target objects that are unsuitable for screen printing, such as those with curved geometries. Spraying techniques are also appropriate for use with the present invention.

The heater must of course be terminated, which can also be done with a wide variety of known techniques. On appropriate example involves the use of silver coated copper lead wires applied onto a terminal pad using the same ink as used for the thick film circuit. This is followed by a standard cure treatment (150° C. for thirty minutes). Any number of standard terminating methods may also be used without departing from the scope of the invention.

Accordingly, while this invention is described with reference to a preferred embodiment of the invention, it is not intended to be construed in a limiting sense. It is rather intended to cover any variations, uses or adaptations in the invention utilizing its general principles. Various modifications will be apparent to persons skilled in the art upon reference to this description. it is therefore contemplated that the appended, and any claims will cover any such modifications or embodiments as fall within the true scope of the invention.

The invention claimed is:

1. A method of manufacturing a thick film heater comprising a heating element applied directly to a surface of a target object, the method comprising the steps of:

applying the heating element, comprising a thick film resistive circuit, directly to the surface of the target object, wherein the thick film resistive circuit is made of a polymer-based ink;

thermally curing the heating element for a first period of time in a standard curing cycle;

sealing the heating element with a dielectric layer; and thermally post-curing the heating element and the dielectric layer for second a period of time in a post-curing cycle, the second period of time being longer than the first period of time.

2. The method of claim 1 further comprising the step of preparing the surface of the target object with a lower dielectric layer, and wherein the heating element in said applying step is applied over the lower dielectric layer.

3. The method of claim 1 wherein said curing step in said standard curing cycle occurs at a temperature of 200° C. or greater.

4. The method of claim 1 wherein said first period of time occurs for a period of two hours or longer.

5. The method of claim 1 wherein the heating element is designed to operate at greater than 15 $W/cm^2$.

6. The method of claim 1 wherein the target object is non-ferrous.

7. The method of claim 6 wherein the target object is aluminum.

8. The method of claim 5 wherein the target object is copper.

9. The method of claim 6 wherein the target object is ceramic.

10. The method of claim 1 wherein the target object comprises high-expansion steel.

11. The method of claim 1 wherein the polymer-based ink of the thick firm resistive circuit comprises an epoxy.

12. The method of claim 10 wherein the polymer-based ink contains silver particles.

13. A thick film heater comprising:

a target object to be heated;

a heating element comprising a polymer-based electrically thick film resistive circuit, the heating element being applied to a surface of the target object, the heating element being thermally cured for a first period of time in a standard curing cycle; and a dielectric layer applied over the heating element, the heating element and the dielectric layer being thermally cured for a second period of time in a post-curing cycle, the second period of time being longer than the first period of time.

14. The thick film heater of claim 13, wherein the first period of time is at least thirty minutes and the second period of time exceeds sixty minutes.

15. The thick film heater of claim 13, wherein the heating element is cured in the standard curing cycle at a temperature of at least 150° C., and wherein the heating element and the dielectric layer are cured in the post-curing cycle at a temperature of at least 200° C.

16. The thick film heater of claim 15, wherein the second period of lime is at least two and a half hours.

17. The thick film heater of claim 16, wherein the second period of time is at least four hours.

18. The thick film heater of claim 14, wherein the heating element is cured in the standard curing cycle at a temperature of at least 150° C., the heating element and the dielectric layer are cured in the post-curing cycle at a temperature of at least 150° C., and the second period of time is at least three hours.

19. The thick film heater of claim 15, wherein the heating element and the dielectric layer are cured in the post-curing cycle at a temperature of at least 225° C., and the second period of time is at least two hours.

20. The thick film heater of claim 13, wherein the heating element is capable of heat flux at least as great as 200 Watts per square inch.

21. The thick film heater of claim 13, wherein the target object is non-ferrous.

22. The thick film heater of claim 21, wherein the target object is comprised of a material selected from the group consisting of: aluminum, copper, and ceramic.

23. The thick film heater of claim 13, wherein the target object comprises high-expansion steel.

24. The thick film heater of claim 13, wherein the heating element further comprises a base dielectric layer disposed between the target object and the electrically resistive circuit.

25. The thick film heater of claim 24, wherein the base dielectric layer consists of a metal oxide selected from the group consisting of $Ti_2$, $SiO_2$, and $AI_2O_3$.

26. The thick firm heater of claim 1, wherein the curing step occurs at a temperature of at least 150° C. and the first time period is at least thirty minutes.

27. The method of claim 26, wherein the post-curing step occurs at a temperature of at least 200° C.

28. The method of claim 27, wherein the second period of time exceeds sixty minutes.

29. The method of claim 27, wherein the second period of time is at least two and a half hours.

30. The method of claim 27, wherein the second period of time is at least four hours.

31. The method of claim 26, wherein the post-curing step occurs at a temperature of at least 150° C., and the second period of time is at least three hours.

32. The method of claim 27, wherein the post-curing step occurs at a temperature of at least 225° C., and the second period of time is at least two hours.

* * * * *